United States Patent [19]

Wright

[11] Patent Number: 4,582,002

[45] Date of Patent: Apr. 15, 1986

[54] FURNITURE ASSEMBLY

[76] Inventor: Leslie S. Wright, 508 Cherry Rd., Gahanna, Ohio 43230

[21] Appl. No.: 703,715

[22] Filed: Feb. 21, 1985

[51] Int. Cl.[4] ..... A47B 57/00

[52] U.S. Cl. ..... 108/111; 211/187; 211/189

[58] Field of Search ..... 108/111, 60; 211/187, 211/189; 446/108, 125, 127

[56] References Cited

U.S. PATENT DOCUMENTS

| | | | |
|---|---|---|---|
| 2,366,677 | 1/1945 | Rosenthal | 108/111 X |
| 3,491,896 | 1/1970 | Crary | 108/111 |
| 3,766,864 | 10/1973 | Baker | 108/111 |
| 4,086,857 | 5/1978 | Igarashi et al. | 108/111 X |

FOREIGN PATENT DOCUMENTS

| | | | |
|---|---|---|---|
| 2455445 | 1/1981 | France | 108/111 |
| 415348 | 10/1946 | Italy | 211/187 |
| 552193 | 11/1956 | Italy | 211/189 |
| 624661 | 6/1949 | United Kingdom | 211/187 |

*Primary Examiner*—William E. Lyddane
*Assistant Examiner*—Peter A. Aschenbrenner
*Attorney, Agent, or Firm*—George Wolken, Jr.

[57] ABSTRACT

A kit is disclosed which permits rapid assembly, disassembly and reassembly in a variety of furniture configurations. The assembly requires no tools and can be carried out at a location remote from the factory in which the kit is produced. The kit may be assembled in a variety of configurations allowing several forms of furniture to be constructed as well as a variety of children's furniture, toys, and playthings. The assembly is sufficiently simple to be carried out by the child and the kit is sufficiently flexible to permit the child to experiment and build many different configurations as the child's ingenuity may suggest. When disassembled, the parts of the kit are easily transportable.

1 Claim, 10 Drawing Figures

FURNITURE ASSEMBLY

BACKGROUND OF THE INVENTION

This invention relates to furniture and more particularly to a kit for the assembly, disassembly, and reassembly of an article of furniture in a variety of configurations, all without the use of tools.

In many families with children, the occasion arises for the children to visit with parents to homes where amusement for children is not readily available. The present invention is intended to provide a kit, containing a relatively few pieces which can be easily stored and transported in its disassembled state. This kit is designed such that the pieces can be assembled into a variety of configurations, can be assembled and reassembled by the child for self-amusement, all without the use of tools.

Although the primary intended use of the present invention is as an article of furniture and plaything for a child, other uses are envisioned. The same pieces as disclosed herein can be made in a small scale for use as doll furniture. Likewise, the pieces can be made to a large scale for adults.

The pieces of the present kit can be made out of any convenient material which has the required strength and safety. Thus, wood and plastic are likely construction materials but cardboard, metal or other relatively rigid materials are not excluded.

SUMMARY AND OBJECTS OF THE INVENTION

The present invention discloses a kit consisting of several relatively flat pieces. Said pieces can be assembled, disassembled and reassembled in a variety of configurations without the use of tools and at a location remote from the factory in which the kit is produced. The several pieces are relatively compact, allowing easy storage and transport of the kit in its disassembled state. The kit may be assembled in a variety of cofigurations allowing several forms of furniture to be constructed as well as a variety of children's furniture, toys and playthings. The assembly is sufficiently simple to be carried out by the child and the kit is sufficiently flexible to permit the child to experiment and build several different configurations as the child's imagination may suggest.

Thus, a primary object of the present invention is to provide a piece of furniture which can be assembled without tools.

It is another object of the present invention to provide a piece of furniture which can be easily disassembled and reassembled into a variety of different configurations.

It is another object of the present invention to provide a piece of furniture which is easily stored and transported when in its disassembled state.

It is yet another object of the present invention to provide an article of furniture which can be reassembled in a variety of configurations by a child exercising his or her creativity and self-guided play.

DESCRIPTION OF PREFERRED EMBODIMENTS

The present invention comprises, in the preferred embodiment, eight planar pieces, typically wood or plastic, which can be assembled in numerous configurations and yet, in the disassembled configuration, can be easily transported. For purposes of illustration, we describe in detail the method for assembly for one typical configuration. Other configurations are possible, and a prime object of the present invention is to permit, in one kit of relatively few pieces, numerous possible methods of assembly, limited only by the inventiveness of the assembler, typically a child. The invention is intended to provide a device which can be stored in relatively small space and can be easily transported. However, because of the numerous ways the pieces can be assembled, the present invention allows a child considerable freedom in designing his or her own methods of use. Thus, a primary use for the present invention is envisioned to be a portable piece of furniture or toy that can be constructed in a variety of ways by a child. It is envisioned that the present invention would be especially useful for children to amuse themselves while accompanying adults on a visit.

Although the preferred embodiment of the present invention envisions use as an article of children's furniture and toy, the invention is not limited to just these uses. The basic configuration of pieces can be assembled in a variety of sizes to encompass doll furniture, adult furniture as well as childs furniture. The description which follows is illustrative of just one way the basic pieces can be assembled to construct a useful article. Many other configurations are possible, limited only by the ingenuity of the assembler.

Figure 1:
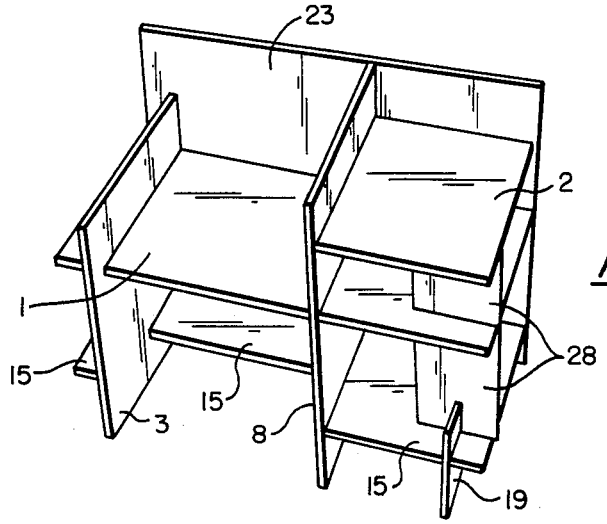
FIG. 1: A perspective view of the invention as assembled for use as a child's desk, seat or T.V. tray.

FIG. 1 shows in perspective view the present invention in one of its possible configurations. When constructed in the appropriate size, it could serve as a child's T.V. seat and tray. To be used as a seat and tray, surface 1 is used as a seat and surface 2 is used as the tray for snacks, etc. The same configuration can also be used as a desk in which the child kneels or sits by surface 1, using surface 1 as the desktop, and the area encompassing surface 2 and the region below surface 2 can be used as shelves. FIG. 1 also can serve as a play house, fort, castle, etc., limited only by the imagination of the child. Therefore, we describe in detail how the eight pieces, FIGS. 3–10 inclusive, easily fit together to form the article of FIG. 1.

Figure 3:
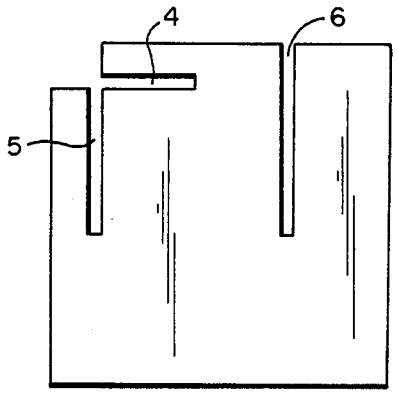
FIGS. 3,4,5,6,7,8,9,10: Planar views of the eight separate pieces, respectively, comprising the disassembled invention.

The assembly of the article shown in FIG. 1 most easily begins by using the piece shown in FIG. 3. The piece shown in FIG. 3 is oriented such that slots 4 and 5 are in the upper rear portion of the assembly shown in the perspective of FIG. 1.

Figure 8:
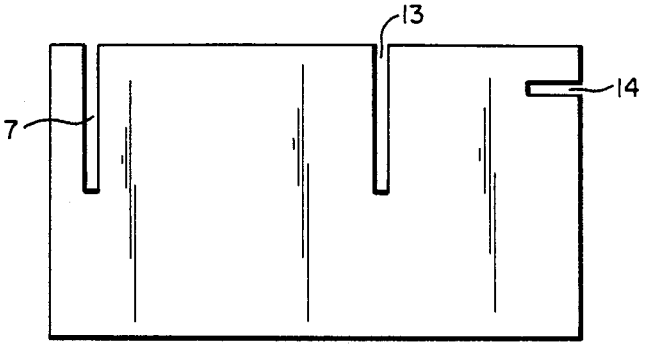

The piece shown in FIG. 8 is typically engaged with the piece of FIG. 3 such that FIG. 8 forms the surface labeled 1 in FIG. 1. FIG. 8 is engaged with FIG. 3 such that slot 7 and slot 5 are intermeshed and the longer section of FIG. 8 extends to the right of FIG. 3 when these two pieces are configured as shown in FIG. 1.

Figure 4:
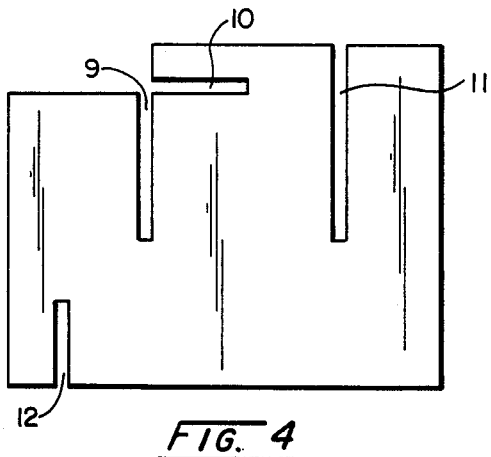

The piece shown in FIG. 4 is then typically assembled to become piece 8 as shown in FIG. 1. Slot 9 of FIG. 4 is intermeshed with slot 13 of FIG. 8, the piece shown in FIG. 4 being configured such that slot 10 is in the upper rear of the assembly in the perspective of FIG. 1.

Figure 7:
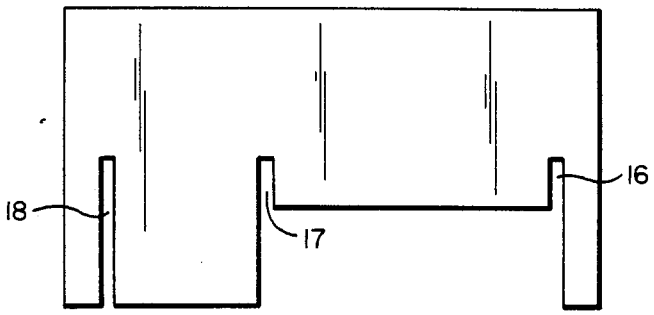

The piece shown in FIG. 7 is then typically added to form the surface labeled 15 in FIG. 1. Slot 16 of FIG. 7 intermeshes with slot 6 of FIG. 3. Slot 17 of FIG. 7 intermeshes with slot 11 of FIG. 4. The open area between slots 16 and 17 forms the knee-space when the article shown in FIG. 1 is used as a child's desk.

Figure 6:
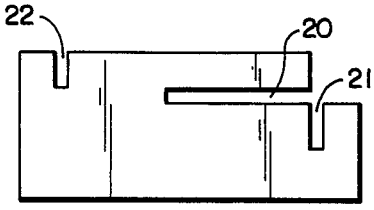

The piece shown in FIG. 6 is then typically added to form the surface labeled 19 in FIG. 1. Slot 20 in FIG. 6 intermeshes with slot 18 of FIG. 7. Slot 22 opens upward and slot 21 is in the rear of the assembly when the piece shown in FIG. 6 in inserted into the assembly in the perspective shown in FIG. 1.

Figure 9:
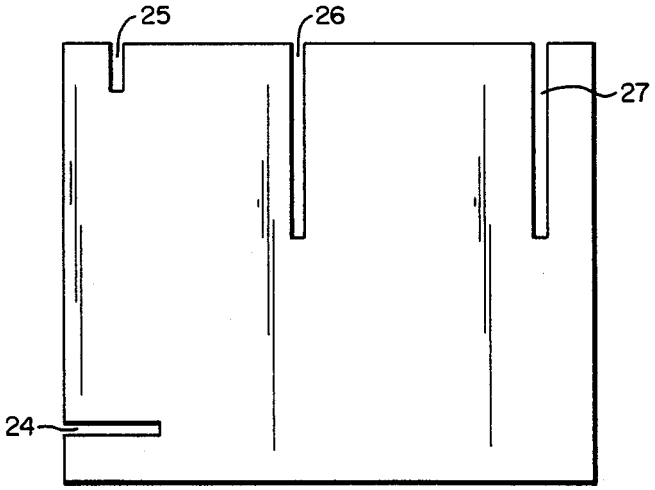

The piece shown in FIG. 9 is then typically added to form the surface labeled 23 in FIG. 1. Slot 27 in FIG. 9 intermeshes with slot 4 in FIG. 1. Slot 26 in FIG. 9 intermeshes with slot 10 in FIG. 4. Slot 25 in FIG. 9 intermeshes with slot 21 in FIG. 6.

Figure 10:
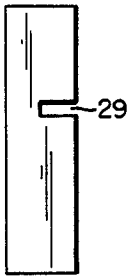

The piece shown in FIG. 10 is then typically added to the assembly to form the surface labeled 28 in FIG. 1. Slot 29 in FIG. 10 intermeshes with slot 14 in FIG. 8. Slot 29 is intentionally positioned slightly off-center in FIG. 10. The longer portion of the piece shown in FIG. 10 extends downward from slot 14, in the perspective shown in FIG. 1, with the end of FIG. 10 resting in slot 22.

Figure 5:
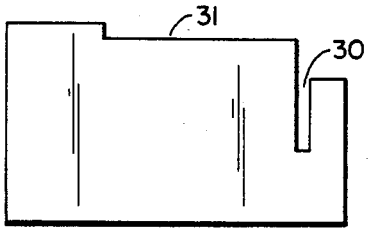

The piece shown in FIG. 5 is then typically added to the structure in FIG. 1 to form the surface labeled 2 in FIG. 1. Slot 30 in FIG. 5 intermeshes with slot 24 in FIG. 9. The half-slot 31 in FIG. 5 intermeshes with the slot 12 in FIG. 4 and resting for support on the upper, shorter end of the piece shown in FIG. 10, comprising surface 28 in FIG. 1.

Figure 2:
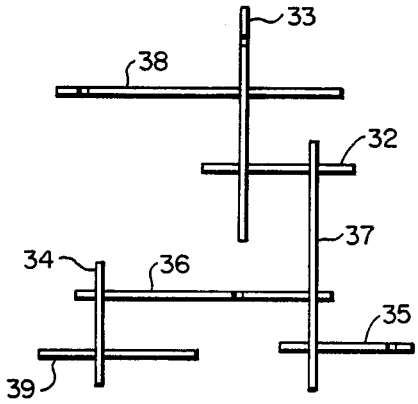
FIG. 2: A top view of the invention as assembled by a child for use as a maze for toy autos.

This procedure describes in detail just one of many possible ways to assemble the structure shown in FIG. 1 from the pieces shown in FIGS. 3–10 inclusive. Also, the structure shown in FIG. 1 is just one possible structure which can be assembled from these eight pieces. One other example of a possible configuration is shown in top view in FIG. 2. The components labeled 32–39 inclusive, correspond in order to the pieces shown in FIGS. 3–10 respectively. FIG. 2 does not form a flat structure, but rather has tunnels and raised portions. FIG. 2 was constructed by a child following his own imagination and used by the child as a course for toy automobiles. FIG. 2 is included here to illustrate that the present invention permits assembly in a variety of configurations. It should also be noted that producing different structures is a source of amusement of the child and an exercise of his or her creativity.

I claim:

1. A kit capable of being readily assembled, disassembled and reassembled into a plurality of configurations, comprising a plurality of pieces, said pieces being relatively thin in comparison to the lateral dimensions thereof and containing relatively narrow, elongate slots, the width of said slots being sufficient to accommodate the thickness of said pieces, said pieces having the following configurations:

(a) a first approximately square piece containing a first set of two parallel, elongate slots of equal length extending approximately perpendicularly from the same edge of said first piece to approximately the midline of said first piece, and a third elongate slot extending in a direction perpendicular to said first set of two slots, extending approximately perpendicularly from an edge of said first piece perpendicular to said edge terminating said first two slots, intersecting one of said two first slots relatively near the edge terminating said intersected first slot, and terminating approximately midway between said first two notches, omitting from said first piece the relatively small rectangular corner portion bounded on two perpendicular edges by said intersecting slots and bounded on the two remaining perpendicular edges by two perpendicular edges of said first piece;

(b) a second rectangular piece containing a first set of two parallel, elongate slots of equal length extending approximately perpendicularly from the same longer edge of said second piece to approximately the midline of said second piece, and a third elongate slot approximately perpendicular to said first two slots, extending from a shorter edge of said second piece, intersecting one of said two first slots relatively near the edge terminating said intersected first slot, and terminating approximately midway between said first two slots, omitting from said second piece the relatively small rectangular corner portion bounded on two perpendicular edges by said intersecting slots and bounded on the two remaining perpendicular edges by two perpendicular edges of said second piece, and a fourth elongate slot, approximately two-thirds the length of said first two notches, terminating on the longer edge of said second piece opposite the terminating edge of the said first two slots, parallel to the shorter edge of said second piece and relatively nearer to said third slot terminating edge than the nearer of said first two slots;

(c) a third rectangular piece having an elongate slot parallel to one longer edge of said rectangle and intersecting a shorter edge of said third piece perpendicular to said longer edge, said first slot approximately two-thirds the length of said longer edge, located such that said longer edge of said third piece is coincident with the outermost edge of said first slot causing an apparent step in said longer edge the width of said slot, and a second slot approximately one-half the length of the shorter side of said third rectangular piece, said second slot perpendicular to said first slot, intersecting said first slot relatively near the shorter edge of said third piece terminating said first slot, and a third slot extending from said second slot to said relatively near shorter side of said third piece, and all portions of said third piece not contiguously connected are excluded from said third piece;

(d) an approximately rectangular fourth piece, containing a first slot approximately one-half the length of the shorter of the edges of said fourth piece, positioned parallel to a first shorter edge and relatively near to said first shorter edge having one end terminating at a first longer edge of said fourth piece, and said fourth piece also contains a second slot approximately one-fourth the length of said shorter edge positioned relatively near the second shorter edge of said fourth piece, opposite said first shorter edge and having one end terminating at said first longer edge, and said fourth piece also contains a third slot, approximately one-half the length of said longer edge, and said third slot is positioned parallel and relatively near to said first longer edge with one edge terminating on said first shorter side thereby intersecting said first slot, omitting from said fourth piece the relatively small rectangular corner not contiguously connected to said fourth piece by the said first and third slots;

(e) a fifth approximately rectangular piece containing three parallel slots of equal length and unequal spacing between said slots, said length approximately one-half the length of the shorter edge of said rectangular fifth piece, and the spacing between the closest pair of slots is approximately one-half the spacing between the next-closest pair of said slots, said three slots positioned with one end of each slot intersecting the same longer edge of said fifth piece, and the two said next-closest slots and joined by a slot parallel to said longer edge and at approximately the mid-point of said next-closest slots, the smaller portion of said fifth piece not contiguously connected is omitted from said fifth piece;

(f) a sixth approximately rectangular piece containing two parallel slots of equal length having one end of each terminating at the same longer edge of said sixth piece, said parallel slots having a length of approximately one-half the length of the shorter edge of said sixth piece, and said sixth piece contains a third slot of length approximately one-ninth the length of the longer edge of said sixth piece, having one end terminating on a shorter edge of said sixth piece, relatively near said longer edge terminating said parallel slots, intersecting none of said parallel slots;

(g) a seventh approximately rectangular piece containing three parallel slots of unequal lengths, each of said slots having one end terminating on a longer edge of said seventh piece, the central of said three slots having a length approximately one-half the length of the shorter edge of said seventh piece, a first peripheral slot of said three parallel slots having a length approximately equal to said central slot, a second peripheral slot having a length approximately one-fourth the central slot and located at a distance from said central slot approximately one-half the distance from the central slot to said first peripheral slot, and said seventh piece containing a fourth slot, approximately one-half the length of the longer of said parallel slots, with one end of said fourth slot terminating in the shorter side of said seventh piece relatively nearer to the shortest of said three parallel slots, and relatively near to the longer edge opposite the terminating edge of said three parallel slots;

(h) an eighth approximately rectangular piece with a slot, approximately one-half the length of the shorter edge of said eighth piece, located approximately in the center of a longer edge of said eighth piece, approximately perpendicular to said longer edge, and one edge of said slot terminating at said longer edge.

* * * * *